US012312787B2

(12) United States Patent
Hirasawa et al.

(10) Patent No.: US 12,312,787 B2
(45) Date of Patent: May 27, 2025

(54) KITCHEN SINK

(71) Applicant: DAINICHI KASEI KOUGYOU CO., LTD., Tokyo (JP)

(72) Inventors: Masatsugu Hirasawa, Tokyo (JP); Jun Hamada, Tokyo (JP)

(73) Assignee: DAINICHI KASEI KOUGYOU CO., LTD., Tokyo (JP)

( * ) Notice: Subject to any disclaimer, the term of this patent is extended or adjusted under 35 U.S.C. 154(b) by 0 days.

(21) Appl. No.: 18/709,736

(22) PCT Filed: Mar. 27, 2024

(86) PCT No.: PCT/JP2024/012331
§ 371 (c)(1),
(2) Date: May 13, 2024

(87) PCT Pub. No.: WO2024/204395
PCT Pub. Date: Oct. 3, 2024

(65) Prior Publication Data

US 2025/0109578 A1 Apr. 3, 2025

(30) Foreign Application Priority Data

Mar. 28, 2023 (JP) ..... 2023-50935

(51) Int. Cl.
*E03C 1/182* (2006.01)

(52) U.S. Cl.
CPC ..... *E03C 1/182* (2013.01)

(58) Field of Classification Search
CPC ..... E03C 1/14; E03C 1/16; E03C 1/18; E03C 1/186
USPC ..... D23/284, 286, 287, 290
See application file for complete search history.

(56) References Cited

U.S. PATENT DOCUMENTS

| | | | | | |
|---|---|---|---|---|---|
| D160,067 | S | * | 9/1950 | Brown | D23/287 |
| 2,889,559 | A | * | 6/1959 | Lyon, Jr. | E03C 1/266 4/642 |
| D259,439 | S | * | 6/1981 | Doman | D23/287 |
| 4,462,126 | A | | 7/1984 | Cleaveland | |
| 5,934,298 | A | | 8/1999 | Singh | |
| 2018/0030704 | A1 | | 2/2018 | Bomatter et al. | |

FOREIGN PATENT DOCUMENTS

| | | | |
|---|---|---|---|
| JP | H0198281 | U | 12/1989 |
| JP | 1994-054028 | B | 7/1994 |
| JP | H1033282 | A | 2/1998 |
| JP | 2001292842 | A | 10/2001 |

(Continued)

*Primary Examiner* — Erin Deery
(74) *Attorney, Agent, or Firm* — Cowan, Liebowitz & Latman, P.C.; Mark Montague

(57) ABSTRACT

A kitchen sink 1 includes: a first sink including a first sink main body that includes a first bottom board, a pair of first side boards attached to short sides, and a pair of first long boards attached to long sides; and a second sink including a second sink main body that includes a second bottom board, a pair of second side boards attached to short sides, and a pair of second long boards attached to long sides. The first sink main body includes a first lid detachably attached to cover a drainage outlet, the second sink main body includes a second lid detachably attached to cover a drainage outlet, and an accommodating portion is formed in the second sink.

7 Claims, 17 Drawing Sheets

(56) References Cited

FOREIGN PATENT DOCUMENTS

| | | | | |
|---|---|---|---|---|
| JP | 2008031637 | A | | 2/2008 |
| JP | 2013127195 | A | | 6/2013 |
| JP | 3207879 | U | | 12/2016 |
| JP | 3214697 | U | * | 2/2018 |
| JP | 3235736 | U | | 1/2022 |

* cited by examiner (a)
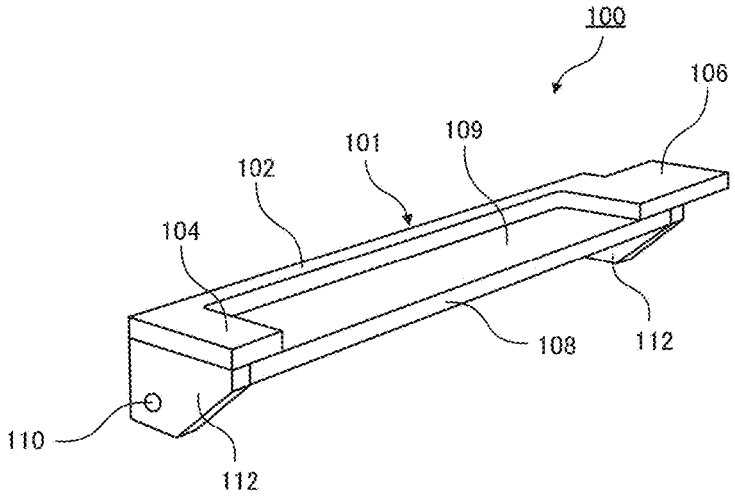
FIG. 12
(b)
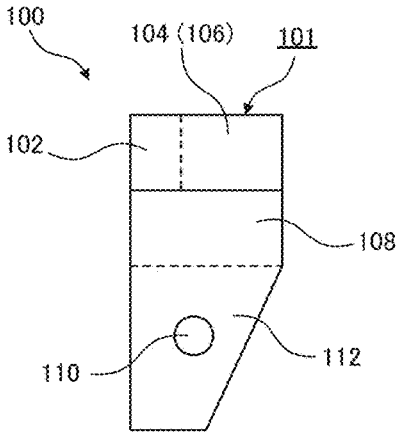

(a)
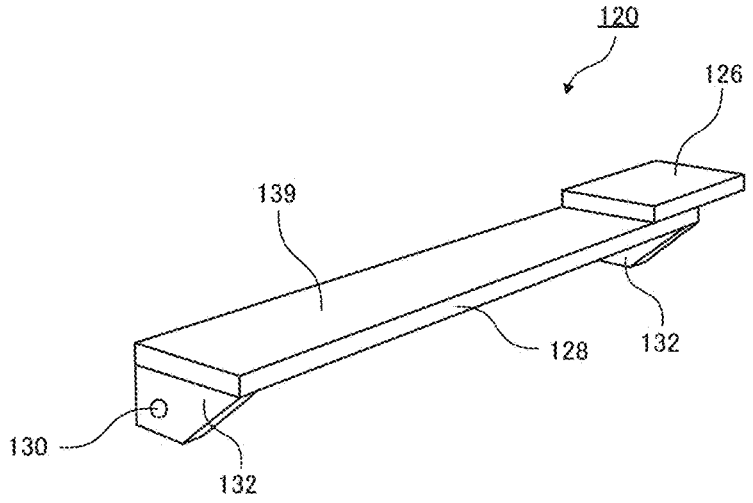
FIG.13
(b)
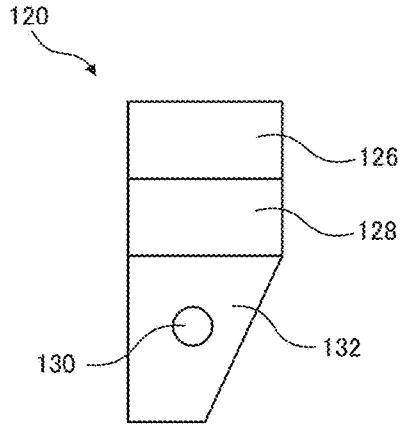

(a)

(b)

(a)

(b)

(a)

(b)

(c)

KITCHEN SINK

TECHNICAL FIELD

The present invention relates to an improvement in a kitchen sink.

BACKGROUND ART

In the related art, sinks for kitchens formed by using acrylic synthetic resin materials, particularly, sinks for kitchens imitating marbles (imitation marble sinks) have beautiful exteriors, look luxury, and have thus widely been used for system kitchens for luxury apartments and luxury houses.

Typical configurations of a kitchen sink include a single sink including one kitchen sink and double sinks of a first kitchen sink and a second kitchen sink aligned side by side (see Patent Literature 1, for example). The double sinks are designed considering utilization of one of the sinks (main sink) as a washing area for tableware and cooking tools and the other (sub-sink) as a washing area for ingredients such as vegetables.

CITATION LIST

Patent Literature

[Patent Literature 1]
Japanese Patent Publication No. 6-54028

SUMMARY OF INVENTION

Technical Problem

Even in double sinks, washed tableware or foods may be placed in one of the sinks in order to use the sink as a drying area, for example. However, a dishwashing detergent, a dishwashing sponge, a cutting board, and the like are often placed in disorder on a top board near the kitchen sinks on a side where water faucets are installed, and the detergent and the cutting board on the top board may thus get in the way, lead to poor usability, and degrade efficiency of a washing work. Furthermore, the surface of the top board is often in a wet state due to the detergent on the top board and water dropping from the cutting board and the like, which is problematic in terms of hygiene.

An object of the present invention is to provide a kitchen sink capable of improving working efficiency and improving hygiene. More specifically, an object of the present invention is to provide a kitchen sink in which a first sink (wide sink) and a second sink (slim sink) configure the shape of the kitchen sink, the depth of the second sink is longer than the depth of the first sink, the thus elongated part is used as an accommodating portion (accommodating pocket) with a stepped portion in which a dishwashing detergent, a dishwashing sponge, a cutting board, and the like can be accommodated, and this prevents stuff from being placed on the top board and enables an exterior that does not damage the sink design to be maintained when the sink is overlooked.

Solution to Problem

A kitchen sink of an embodiment to achieve the object includes: a first sink (1A) including a first sink main body (2A) that includes a first bottom board (3A) obtained by inclining an entire inner bottom surface in a direction of a first drainage outlet (9) provided at a Corner on one side, a pair of first side boards (5) attached to short sides (4) of the first bottom board (3A) on both left and right sides, and a pair of first long boards (7) attached to long sides (6) of the first bottom board (3A) in a front-rear direction; and a second sink (1B) including a second sink main body (2B) that includes a second bottom board (3B) obtained by inclining an entire inner bottom surface in a direction of a second drainage outlet (9) provided at a corner on one side, a pair of second side boards (37, 58) attached to short sides (36, 56) of the second bottom board (3B) on both front and rear sides, and a pair of second long boards (5, 35) attached to long sides (34) of the second bottom board (3B) in a left-right direction, in which the first sink main body (2A) includes a first lid (30) detachably attached to cover the drainage outlet (9) in the first bottom board (3A), the second sink main body (2B) includes a second lid (30) detachably attached to cover the drainage outlet (9) in the second bottom board (3B), an accommodating portion (57) is formed in the second sink (1B), depth dimensions of the first sink main body (2A) and the second sink main body (2B) are same, a depth dimension of the second sink (1B) is longer than a depth dimension of the first sink (1A), and the accommodating portion (57) is formed in an area other than the second sink main body (2B) in the second sink (1B), and the accommodating portion (57) is configured to include a first side board (57*a*), a stepped portion (57*b*), and a second side board (58), and a height of the first side board (57*a*) is equal to or greater than a height of the second lid (30).

(2) In a kitchen sink of another embodiment, holding portions (70, 100, 120) for holding an accommodating basket (140) are attached to an opening of the second sink (1B).

(3) Preferably, in a kitchen sink of another embodiment, the first lid (30) and the second lid (30) may include drainage flow paths (31) each formed at a center of four sides of a bottom surface formed into a square shape, with locking portions (33) provided at four corners of the bottom surface.

(4) Preferably, in a kitchen sink of another embodiment, inclined surfaces (10) may be provided at edges of two sides of the respective drainage outlets (9) in the first sink main body (2A) and the second sink main body (2B) in contact with inner bottom surfaces of the bottom boards (3), fitting portions (11) with substantially square shapes may be attached to be slightly lower than edges of the drainage outlets (9), and corner pieces (12) with slope portions (13) formed to have substantially triangular sections may be attached to sides of the fitting portions.

(5) Preferably, in a kitchen sink of another embodiment, locking portions (33) of the first lid (30) and the second lid (30) may be provided with inclined portions abutting on slope portions (13) of corner pieces (12) provided at respective sides of the drainage outlets (9).

(6) Preferably, in a kitchen sink of another embodiment, the first lid (30) and the second lid (30) may be provided with inclined surfaces (38) obtained by gently inclining entire peripheral edges of surface portions (32).

(7) Preferably, in a kitchen sink of another embodiment, the first sink main body (2A) and the second sink main body (2B), a top board (8), the first lid (30) and the second lid (30), and the accommodating portion (57) may be formed from an imitation board material obtained by molding and working a synthetic resin material, by molding and working crushed crystal with a synthetic resin material, or by molding and working ceramic tiles.

Advantageous Effects of Invention

According to the present invention, since a first sink (wide sink) and a second sink (slim sink) configure the shape of a kitchen sink, the depth of the second sink is longer than the depth of the first sink, and the thus elongated part is used as an accommodating portion (accommodating pocket) with a stepped portion in which a dishwashing detergent, a dishwashing sponge, a cutting board, and the like can be accommodated, when the sink is looked down, a work can be performed inside the second sink without placing various kitchen utensils (a detergent, a cutting board, and the like) used for works in the kitchen on the top board, and it is thus possible to improve working efficiency while maintaining an exterior that does not damage the sink design.

BRIEF DESCRIPTION OF DRAWINGS

FIG. 12(*a*) is a perspective view illustrating a structure of a holding member in another embodiment 2, and FIG. 12(*b*) is a side view of the holding member in FIG. 12(*a*).

FIG. 13(*a*) is a perspective view illustrating a structure of a holding member in another embodiment 3, and FIG. 13(*b*) is a side view of the holding member in FIG. 13(*a*).

DESCRIPTION OF EMBODIMENTS

Hereinafter, embodiments of the present invention will be described with reference to the drawings. Note that the embodiments described below do not limit the invention of each of the claims. Also, all of various elements and combinations thereof described in the embodiments are not necessarily essential for the solution to the invention.

Figure 1:
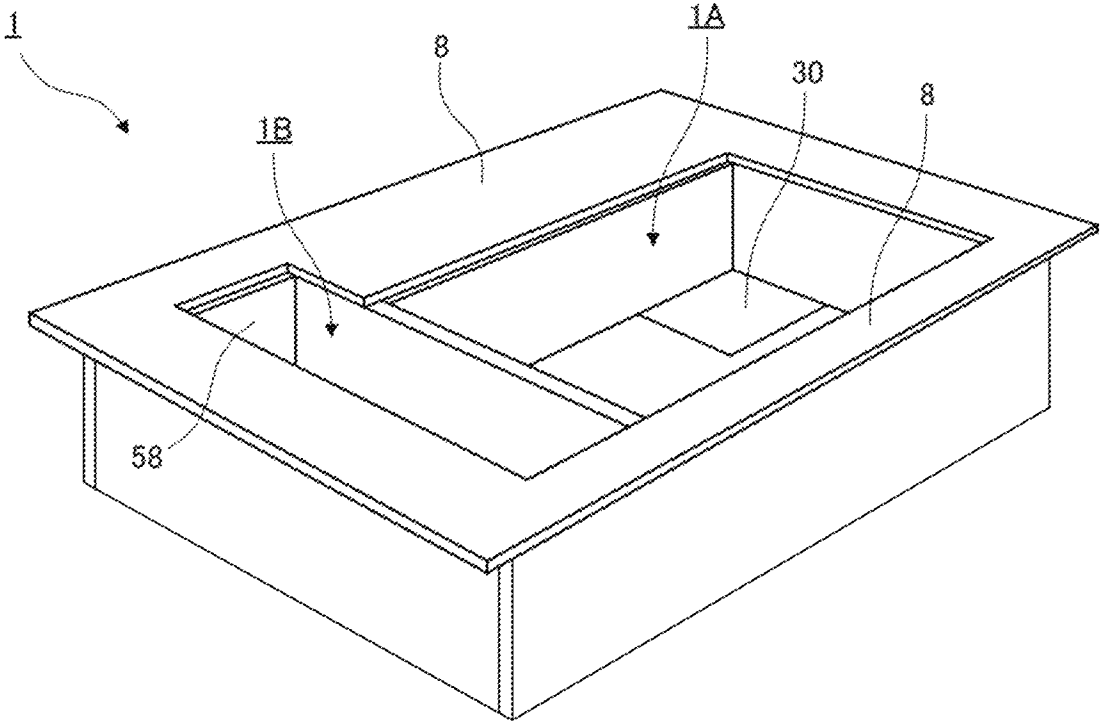
FIG. 1 is a perspective view of a kitchen sink.
Figure 2:
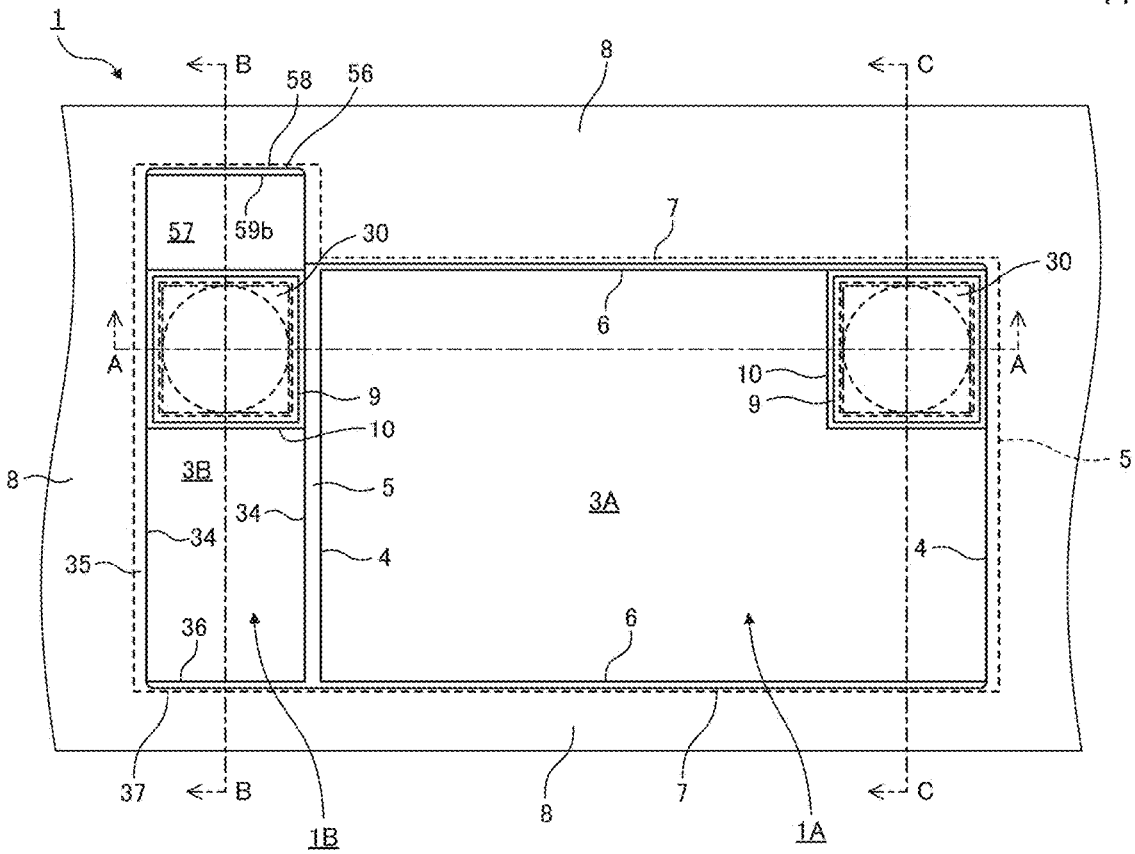
FIG. 2 is a plan view of the kitchen sink.
Figure 3:
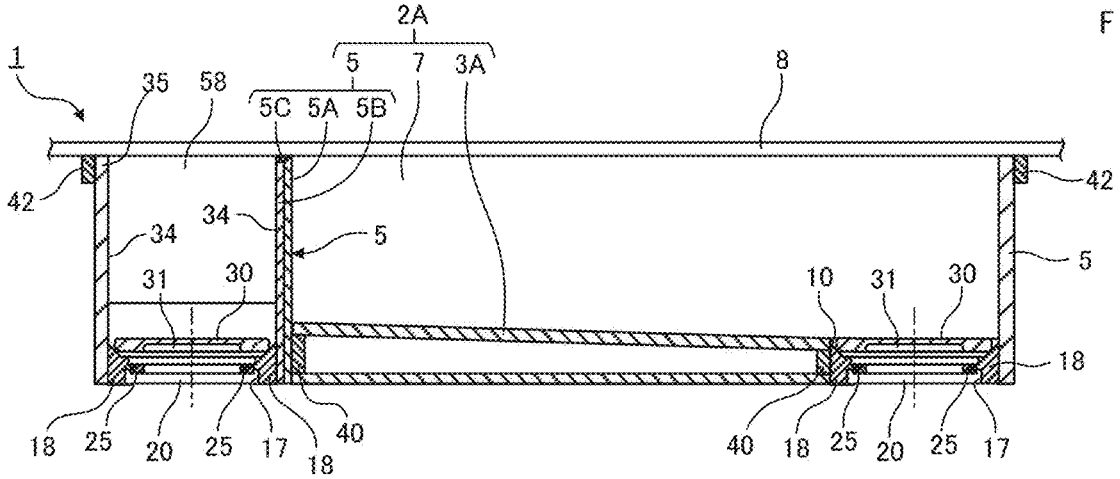
FIG. 3 is a sectional view along the line A-A in FIG. 2.
Figure 4:
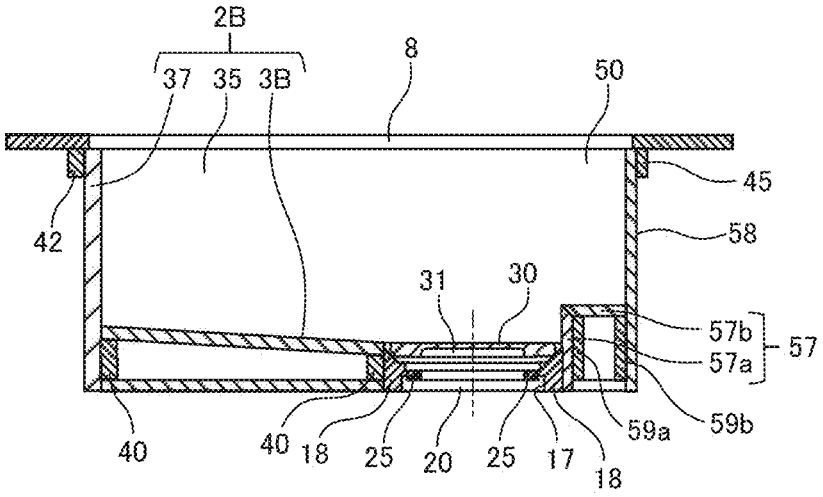
FIG. 4 is a sectional view along the line B-B in FIG. 2.
Figure 5:
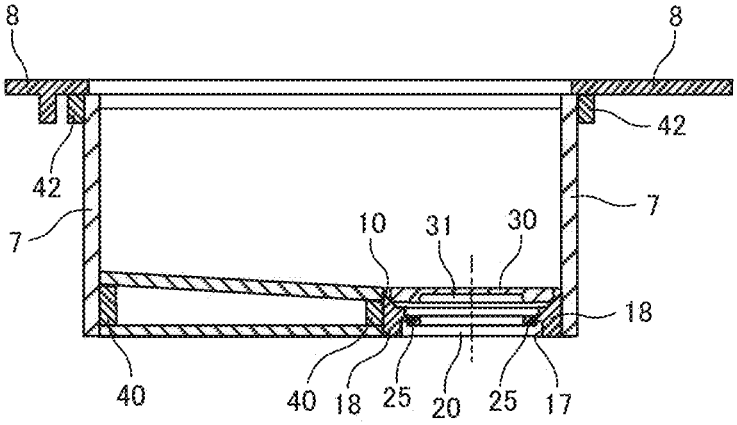
FIG. 5 is a sectional view along the line C-C in FIG. 2.
Figure 6:
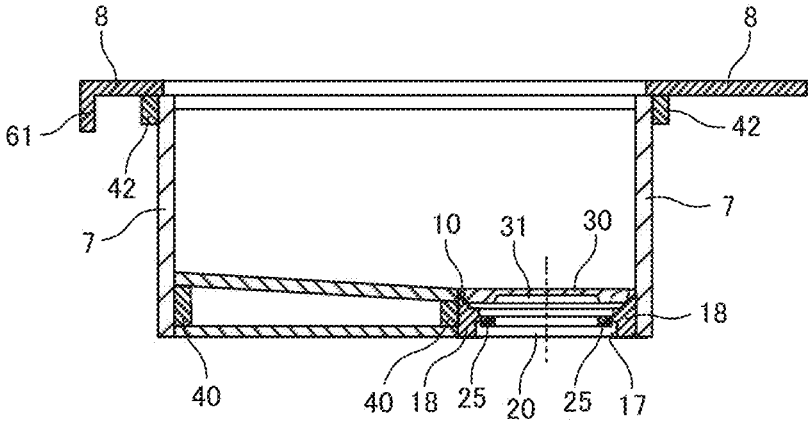
FIG. 6 is a sectional view illustrating another example of a top board shape.
Figure 7:
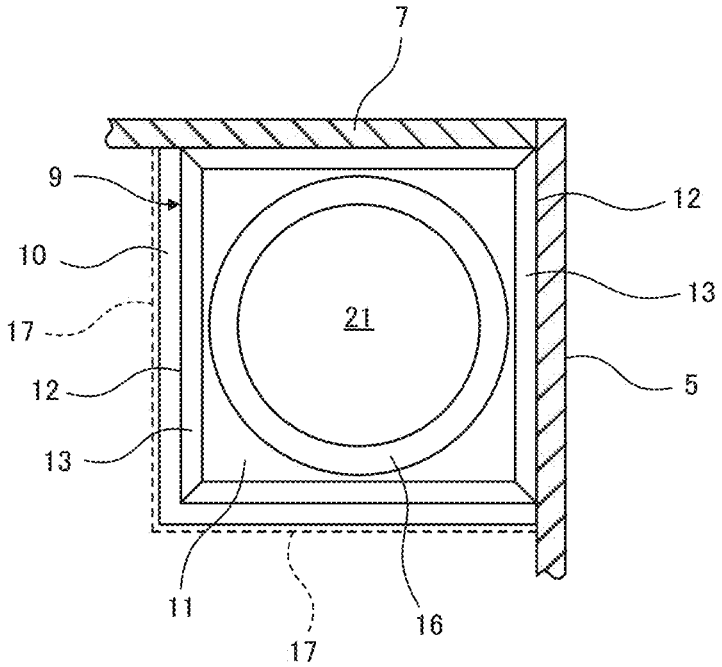
FIG. 7 is a main portion enlarged sectional view of a drainage outlet.
Figure 8:
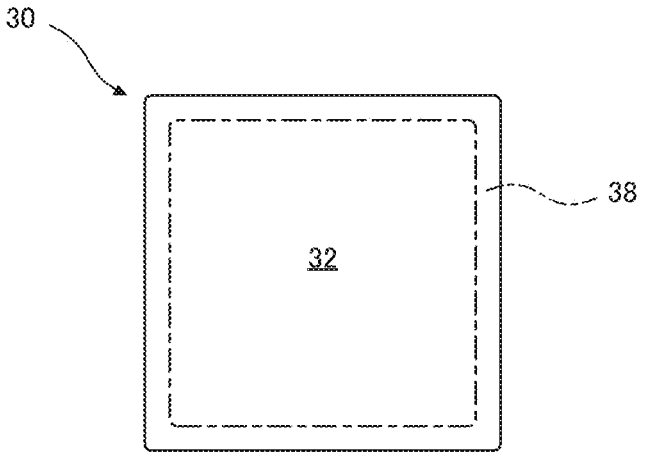
FIG. 8 is a plan view of a lid.
Figure 9:
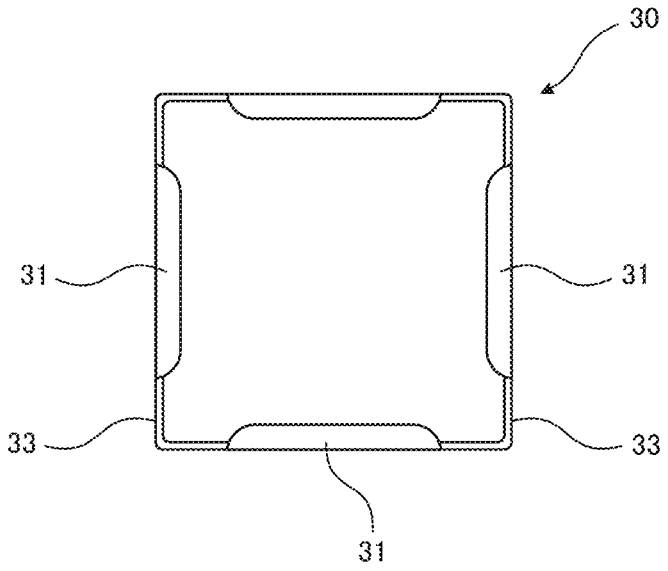
FIG. 9 is a bottom view of the lid.

In the embodiment, FIG. 1 is a perspective view of a kitchen sink, FIG. 2 is a plan view of the kitchen sink, FIG. 3 is a sectional view along the line A-A in FIG. 2, FIG. 4 is a sectional view along the line B-B in FIG. 2, FIG. 5 is a sectional view along the line C-C in FIG. 2, FIG. 6 is a sectional view illustrating another example of a top board shape, FIG. 7 is a main portion enlarged sectional view of a drainage outlet, FIG. 8 is a plan view of a lid, and FIG. 9 is a bottom view of the lid. Note that a kitchen sink 1 is formed into a geometric rectangular shape by bonding to each other resin boards formed of a synthetic resin material, for example, an acrylic or polyester-based resin material and imitating marbles, imitating stone boards obtained by molding quartz (crystal crushed into a granular shape) as a main constituent with a resin material and imitating marbles, or further imitating board materials made of ceramic tile plates or the like,

[Kitchen Sink 1]

A kitchen sink 1 of the embodiment is configured to include a first sink 1A and a second sink 1B, The first sink 1A is a sink mainly for washing tableware and foods (vegetables, for example), for example, and the second sink 1B is a sink mainly for temporarily placing and drying the tableware and the foods after being washed in the first sink 1A. However, the embodiment is not limited thereto, and on the contrary to the above, the first sink 1A may be used as a drying area, and the second sink 1B may be used as a washing work area, for example.

As for the first sink 1A and the second sink 1B in the embodiment, the first sink 1A is positioned as a wide sink, the second sink 1B is positioned as a slim sink, and the volume of the first sink 1A is larger than the volume of the second sink 1B. The depth dimension (depth size) of the second sink 1B is larger than that of the first sink 1A in order to provide an accommodating portion 57 while not damaging an exterior design as will be described later, The second sink 1B roughly has two areas, namely an area with a sink function (mainly a function of securing an area for a washing work, a function of securing an area for placing tableware and the like after being washed for drying, and the like) and an area with an accommodating function (a function of securing an area for placing a detergent and the like). In regard to the depth dimension corresponding to the area with the sink function out of the areas, the depth dimension corresponding to the sink function of the second sink 1B is substantially the same as the depth dimension of the first sink 1A, a depth with which the accommodating function can be exhibited is further added, and the depth dimension of the second sink 1B as a whole is thereby longer than the depth dimension of the first sink 1A. The enlarged area is used as an accommodating area. Note that the height and the width of the accommodating area are also appropriately designed within ranges in which the accommodating function can be exhibited and can be freely changed without damaging the design. Note that although the sink areas have been described separately for the sink function area and the accommodating function area for the sake of descriptive convenience, it is also possible to consider the functions on the basis of a concept that the second sink 1B does not have the sink function and has only the accommodating function, for example, and the concept related to the functions is not limited to the above and may be appropriately changed.

[First Sink 1A]

The first sink 1A is made by forming a sink main body 2A that includes a bottom board 3A including a drainage outlet 9, a pair of side boards (short boards) 5 attached to short sides 4 of the bottom board 3A in a short side direction, and a pair of side boards (long boards) 7 attached to long sides 6 of the bottom board 3A in the front-rear direction, a top board 8 formed by joining longitudinally and laterally to upper end edges of the sink main body 2A in the horizontal direction, and a lid 30 detachably attached to cover the drainage outlet 9 provided in the bottom board 3A of the sink main body 2A, using an imitating board material that is the same material as that of the sink main body 2A. It is possible to form a sense of unity and a sense of oneness by forming the sink main body 2A, the top board 8, and the lid 30 configuring the first sink 1A using the same material.

For the sink main body 2A, the side board (left side board) 5 is attached in the vertical direction below the left short side 4 of the bottom board 3A via a coupling member (coupling piece) 40, the side board (right side board) 5 is attached in the vertical direction on the right side of the lid 30 disposed on the right side of the bottom board 3A, the side board (long board) 7 in the front direction is attached in the vertical direction below the long side 6 of the bottom board 3A in the front direction via the coupling member 40, the side board (right side board) 7 is attached in the vertical direction on the further side (rear side) of the lid 30 disposed in the rear direction of the bottom board 3A, and joining end surfaces of the side boards 5 and the side board (long boards) 7 are bonded and joined to each other at a right angle, as illustrated in FIGS. 2, 3, and 5.

As illustrated in FIGS. 3 and 5, the top board 8 is formed by joining longitudinally and laterally to upper end edges of the side boards 5 and the side boards (long boards) 7 in the horizontal direction, and is bonded and attached to each of outer side surfaces of the side boards 5 and the side boards (long boards) 7 of the sink main body 2A via coupling members 42, to thereby form a space where a faucet for supplying hot water to the sink, cooking tools, and the like are placed. Note that other shapes of the top board include a shape with a front hanging part 61 extending vertically downward from a lateral side on a longer side of the top board 8 on the front side of the sink as illustrated in FIG. 6, for example.

As for the bottom board 3A configuring the sink main body 2A, the entire inner bottom surface is formed with a slightly lowered gradient of 1 to 3 degrees, or preferably 1.5 degrees toward the direction of the drainage outlet 9 provided at a corner on one side for satisfactory water drainage, two sides that are edges of the drainage outlet 9 provided in the bottom board 3A are chamfered to provide an inclined surface 10 to prevent remaining water (so-called dead water) at the part of the drainage outlet 9 due to a surface tension of flowing water, and a lid 30 formed from an imitating board material formed from the same material as that of the first sink 1A is detachably attached to the upper surface of the drainage outlet 9.

The drainage outlet 9 is configured by a fitting portion 11 formed into a substantially square shape to be slightly lower than the inner bottom surface of the bottom board 3A and a drainage frame 17 and a fixation frame 18 holding the fitting portion 11, as illustrated in FIGS. 3 and 7. A corner piece 12 with a slope portion 13 formed to have a substantially triangular section is attached to each side on the upper surface of the fitting portion 11, and a water flowing hole 15 is provided at the center.

As illustrated in FIG. 3, a drainage tube 20 for causing washing water inside the first sink 1A to smoothly flow downward is attached to a water flowing hole 21 provided at the center of the fitting portion 11. A fixation ring 25 is attached to the drainage tube 20 to fix it to the fixation frame 18 located at a lower portion of the fitting portion 11. A garbage basket (not illustrated) for accommodating vegetable scraps, food scraps, and the like flowing downward together with washing water can be attached to the drainage tube 20.

The lid 30 is made of an imitating board material molded and worked using the same material as that of the sink main body 2A as described above, and is formed into a square shape such that the lid 30 is detachably attached to the fitting portion 11 of the drainage outlet 9 formed into a square shape as illustrated in FIGS. 6 and 7. A drainage flow path 31 obliquely cut out the center in a longitudinal direction is formed at each of four sides of the bottom surface of the lid 30, an L-shaped locking portion 33 is provided at each of four corners of the bottom surface, and an inclined portion (not illustrated) abutting on the slope portion 13 of the corner piece 12 of the drainage outlet 9 is provided at a lower end of the locking portion 33.

Furthermore, the locking portions 33 provided at the four corners of the bottom surface of the lid 30 increase contact areas between the lid 30 and the corner pieces 12 by providing the inclined portion (not illustrated) abutting on the slope portion 13 of the corner piece 12 provided at each side of the drainage outlet 9, it is possible to prevent the lid 30 from being displaced from the center position of the drainage outlet 9 by the inclined portion (not illustrated) abutting on the slope portion 13 at each of the four corners, and it is possible to stably position the lid 30 without the lid 30 rattling and without displacement even under a water pressure due to a large amount of discharged water.

It is possible to cause a sense of luxury without unnatural feeling from the lid 30 when the first sink 1A is overlooked, by the upper surface of the lid 30 located at the drainage outlet 9 and the peripheral edge of the drainage outlet 9 being formed to have heights in substantially the same plane. Moreover, it is possible to prevent remaining water remaining in a surface portion 32 due to a surface tension and to facilitate flowing of flowing water in the surface portion 32 by providing an inclined surface 38 gently inclined at the peripheral edge of the surface portion 32 of the lid 30, Since the same applies to the second sink 1B, which will be described below, in terms of the above points, description regarding the above points will thus be omitted.

[Second Sink 1B]

The second sink 1B is made by forming a sink main body 2B including a bottom board 3B including a drainage outlet 9, side boards 37 and 58 respectively attached to lateral sides (short sides) 36 and 56 of the bottom board 3B in the short side direction, and a pair of side boards (long boards) 5 and 35 attached to long sides 34 of the bottom board 3B in the long side direction, an accommodating portion 57, a top board 8 formed by joining longitudinally and laterally to upper end edges of the sink main body 2B in the horizontal direction, and a lid 30 detachably attached to cover the drainage outlet 9 provided in the bottom board 3B of the sink main body 2B using an imitation board material that is the same material as that of the sink main body 2B. The side boards 5 are configured by joining a first side board 5*a* on the side of the first sink 1A, a second side board 5*b* on the side of the second sink 1B, and a stopper cut board (substantially triangular section) 5*c* intervening between top portions of the first side board 5*a* and the second side board 5*b*. Hereinafter, the side board functioning as a boundary board between the first sink 1A and the second sink 1B will be described as a side board 5 as long as it is not necessary to particularly distinguish them. Note that as reasons for such a structure, a first reason is for increasing a contact area between the first side board 5*a* and the second side board 5*b*, and a second reason is for unifying a pattern on the side of the first sink 1A and a pattern on the side of the second sink 1B since there are originally no patterns on the rear side of the material of the side boards. Of course, patterns may be formed on both surfaces of one side board. It is possible to form a sense of unity and a sense of oneness by forming the sink main body 2B, the accommodating portion 57, the top board 8, and the lid 30 configuring the second sink 1B from the same material. Note that since structures around the drainage of the sink main body 2B, particularly, a structure near the drainage outlet and a structure of the lid are similar to the structure near the drainage outlet and the structure of the lid of the first sink 1A, the same reference signs will be applied, and description of the structures and effects will be omitted.

As for the sink main body 2B, the side board 37 on a shorter side is attached in the vertical direction below the short side 36 on the front side of the bottom board 3B via a coupling member 40, the side board 58 on the shorter side is attached in the vertical direction on the side further behind the lid 30 on the rear side of the bottom board 38 via a coupling member 45 (see FIG. 4), the side board (long board) 35 is attached in the vertical direction below the long side 34 of the bottom board 3B in the long direction (both left and right sides) via the coupling member 40, and joining end surfaces of the side boards 35 and 58 and the side board 37 are bonded and joined to each other at a right angle. The side boards (long boards) 35, the side boards 37 and 58, and the side board 5 (shared with the sink main body 2A) form the outer periphery of the second sink, as illustrated in FIGS. 2 to 4.

The top board 8 is joined to upper end edges of the side board (long board) 35, the side board 37, and the accommodating portion 57 as illustrated in FIGS. 2 to 4, and a rear surface of the top board 8 is bonded and attached to the upper end surfaces of the side board (long board) 35, the side board 37, and the accommodating portion 57 of the sink main body 2B. Note that the accommodating portion 57 and the top board 8 are joined via the coupling member 45 to further improve fixation strength of the accommodating portion 57.

As for the bottom board 3B configuring the sink main body 2B, the entire inner bottom surface is formed with a slightly lowered gradient of 1 to 3 degrees, or preferably 1.5 degrees toward the direction of the drainage outlet 9 provided at a corner on one side for satisfactory water drainage, two sides that are edges of the drainage outlet 9 provided in the bottom board 3B are chamfered to provide an inclined surface 10 to prevent remaining water at the part of the drainage outlet 9 due to a surface tension of flowing water, and a lid 30 formed from an imitating board material formed from the same material as that of the first sink 1A is detachably attached to the upper surface of the drainage outlet 9.

The accommodating portion 57 configuring the sink main body 2B is configured to include a lower side board (first side board) 57*a*, a stepped portion 57*b*, and a part of a side board (second side board) 58 as illustrated in FIG. 4. A pocket accommodating area 50 for accommodating a detergent, a detergent sponge, and the like is defined above the stepped portion 57*b*. Note that the stepped portion 57*b* is joined to the side board 58 on the side of the sink rear surface via the coupling member 45, is joined to a lower side board 57*a* via a coupling member 59*a*, and is joined to the side board 58 via a coupling member 59*b*. The accommodating portion 57 may be integrally molded, for example, as well as the aforementioned mode.

When a detergent, a detergent sponge, and the like are accommodated in the pocket accommodating area 50, the volume of the space in the pocket accommodating area 50 can be changed by changing the height of the lower side board 57*a*. It is only necessary to raise the height of the lower side board 57*a* when it is desired to reduce the volume of the space in the pocket accommodating area 50, and it is only necessary to lower the height of the lower side board 57*a* when it is desired to increase the volume of the space in the pocket accommodating area 50, for example. Note that the height of the lower side board 57*a* needs to be equal to or greater than the height of the lid 30. The reason is because the likelihood that water from the bottom surface of the second sink enters the stepped portion 57*b* increases if the height of the lower side board 57*a* is lower than the height of the lid 30, and it is preferable that no water enter the stepped portion 57*b* in consideration of hygiene.

Another Embodiment 1

Figure 10:
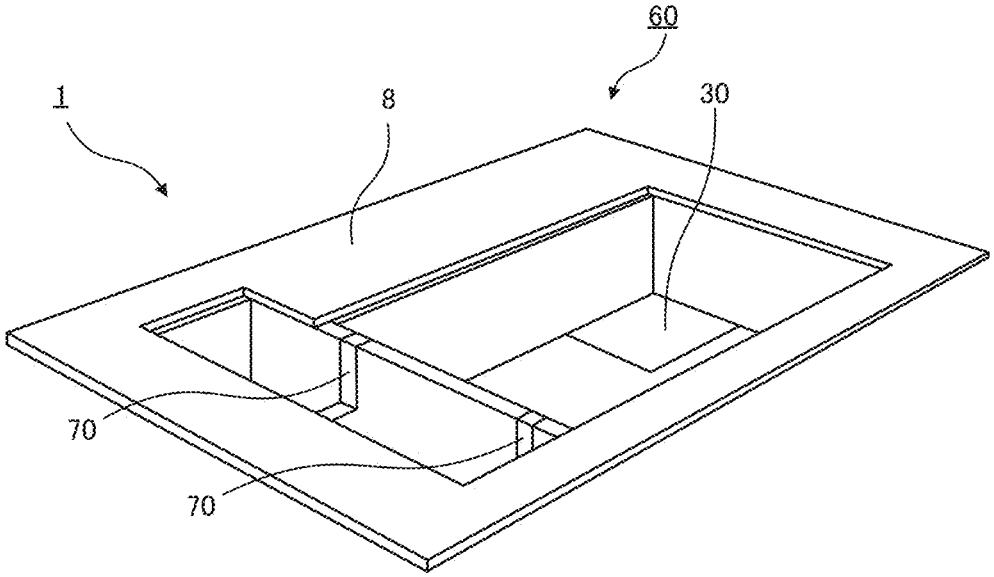
FIG. 10 is a perspective view illustrating another embodiment 1 of a kitchen sink.
Figure 11:
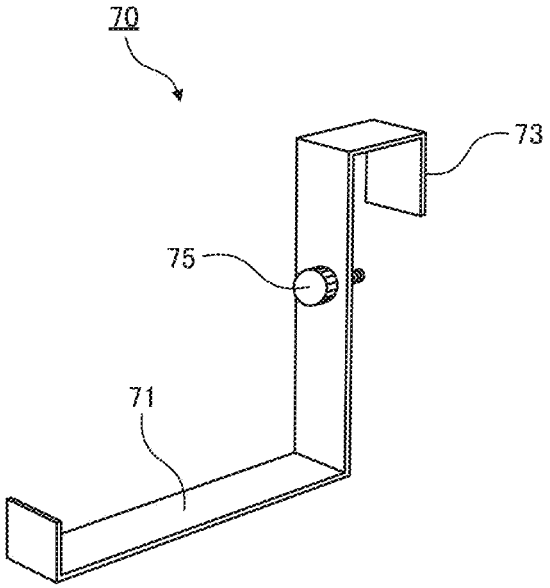
FIG. 11 is a diagram illustrating a structure of a bracket.

In the aforementioned embodiment, the area of the second sink 1B with the sink function is basically used to place washed tableware, foods, and the like. However, it may not be desired to directly place the washed tableware, foods, and the like on the bottom board 3B of the second sink 1B. Thus, a hook portion 73 of a bracket 70 can be hooked at an upper end edge of the side board 5 as a boundary between the first sink 1A and the second sink 1B, and can then be tightened and fixed with a screw member 75 to cause a holding portion 71 to hold a draining basket (see FIG. 16), for example, as illustrated in FIGS. 10 and 11. If washed tableware, foods, and the like are accommodated in the draining basket by providing a bracket functioning as the holding member for holding the draining basket in this manner, it is possible to hold and save the washed tableware, foods, and the like without placing them directly on the bottom board 3B, and it is possible to satisfy a requirement of a user in terms of hygiene, for example, Note that FIG. 10 is a perspective view illustrating the another embodiment 1 of the kitchen sink, and FIG. 11 is a diagram illustrating a structure of the bracket.

Another Embodiment 2

Figure 14:
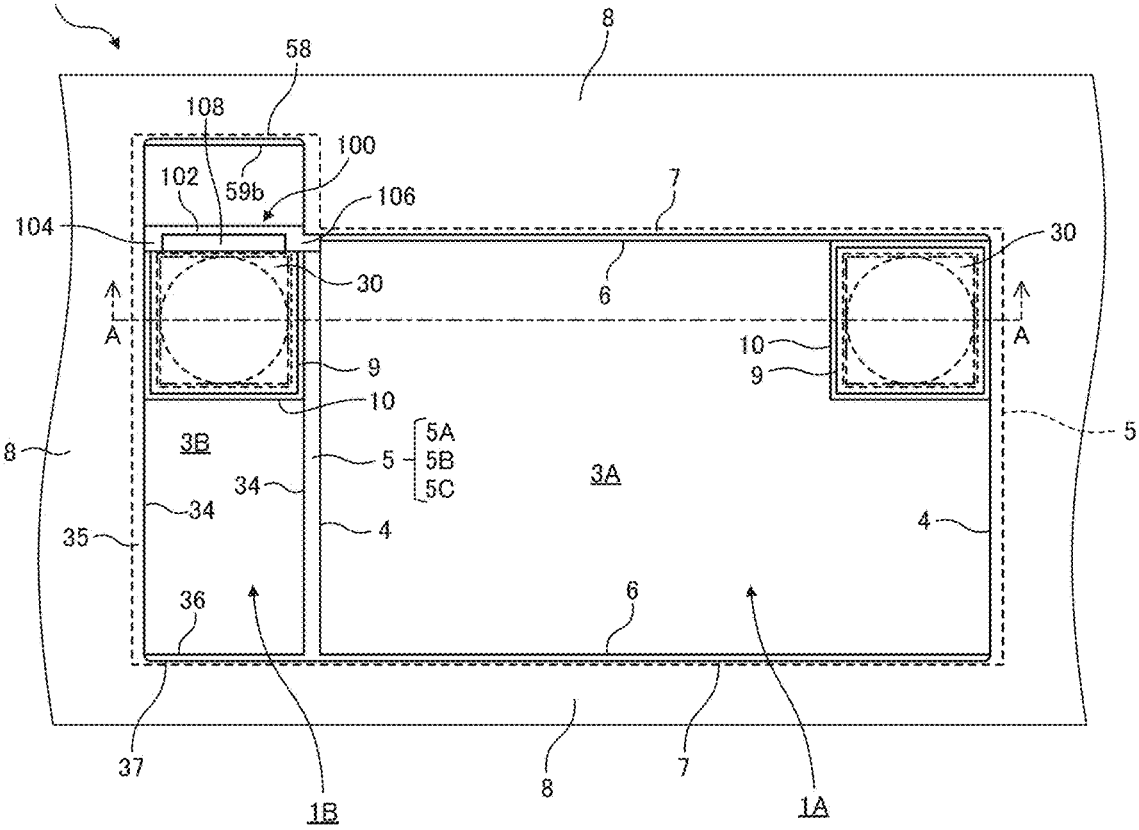
FIG. 14(*a*) is a plan view illustrating a state where the holding member in the another embodiment 2 is placed on a second sink, and FIG. 14(*b*) is a sectional view along the line A-A in FIG. 14(*a*).
Figure 14:
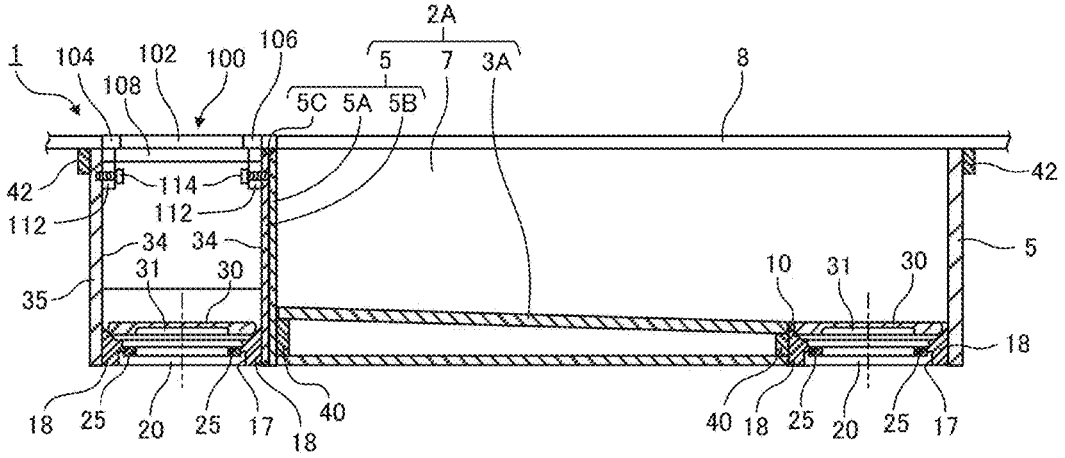

Although the holding member in the aforementioned another embodiment 1 has a bracket shape, the holding member may have a shape as illustrated in FIG. 12. FIG. 12(*a*) is a perspective view illustrating a structure of a holding member in another embodiment 2, and (*b*) is a side view of the holding member in (*a*). FIG. 14(*a*) is a plan view illustrating a state where the holding member in the another embodiment 2 is placed on a second sink, and (*b*) is a sectional view along the line A-A in (*a*).

As illustrated in FIG. 12, a holding member (support part) 100 is configured to include a support board 108, arm portions 112 and 112 joined to both ends of the support board 108, and a positioning board 101 with a substantially U shape. The positioning board 101 is configured by a base 102 and leg portions 104 and 106 formed integrally with both ends of the base 102, and a recessed portion 109 surrounded by the leg portions 104 and 106 is formed. The dimension (width dimension) of the recessed portion 109 in the longitudinal direction is preferably longer than the width of a draining basket (see FIG. 16). Insertion holes 110 and 110 for inserting screw members (such as bolts) 114 are formed in arm portions 112 and 112, respectively. Spiral grooves are formed in the insertion holes 110 and 110. Since the holding member 100 is movable in the depth direction of the second sink 1B in a state before the holding member 100 is tightened and fixed with the screw members 114, the holding member 100 is positioned and adjusted to substantially coincide with the depth dimension of the draining basket to be held and is then tightened and fixed with the screw members 114.

The holding member 100 is fixed at a predetermined position of an opening of the second sink 1B with the Screw members 114. Specifically, leg portions 106 of the holding member 100 are placed on the upper end surface of the side board 5 as illustrated in FIGS. 14(*a*) and (*b*), a screw member 114 is inserted into insertion holes 110 in left and right arm portions 112 while being rotated with the holding member 100 horizontally maintained, a pressure is applied from the inside to the outside, and distal ends of the screw members 114 are thus caused to abut on, and fastened and fixed to, the surfaces of the side boards 5*b* and 35. If washed tableware, foods, and the like are accommodated in a draining basket by placing and holding (see FIG. 17) the draining basket (see FIG. 16) at the upper end edges of the recessed portion 109 and the side board 37 on the shorter side, it is possible to hold and save the washed tableware, foods, and the like without placing them directly on the bottom board 3B and to satisfy a requirement of a user in terms of hygiene, for example.

(Draining Basket)

Figure 16:
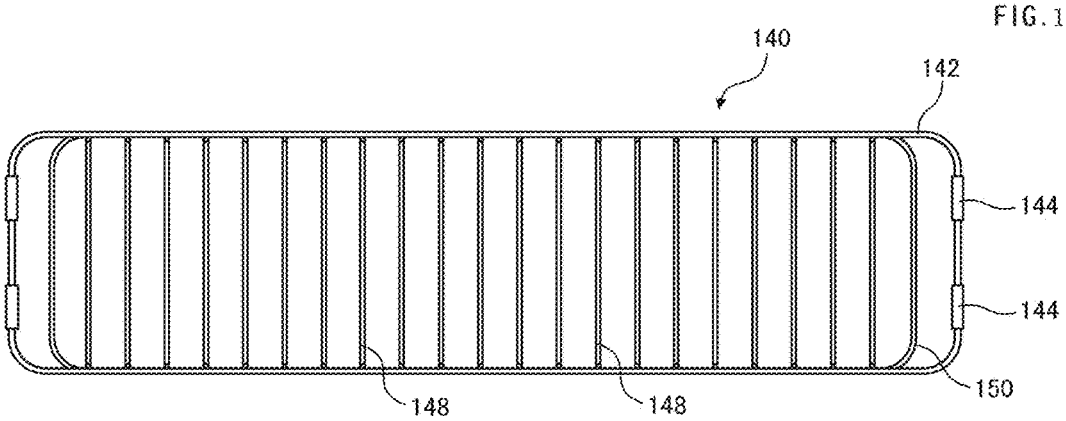
FIG. 16(*a*) is a plan view illustrating a structure of a draining basket, FIG. 16(*b*) is a side view of the draining basket in FIG. 16(*a*), and FIG. 16(*c*) is a front view of the draining basket in FIG. 16(*a*).
Figure 16:
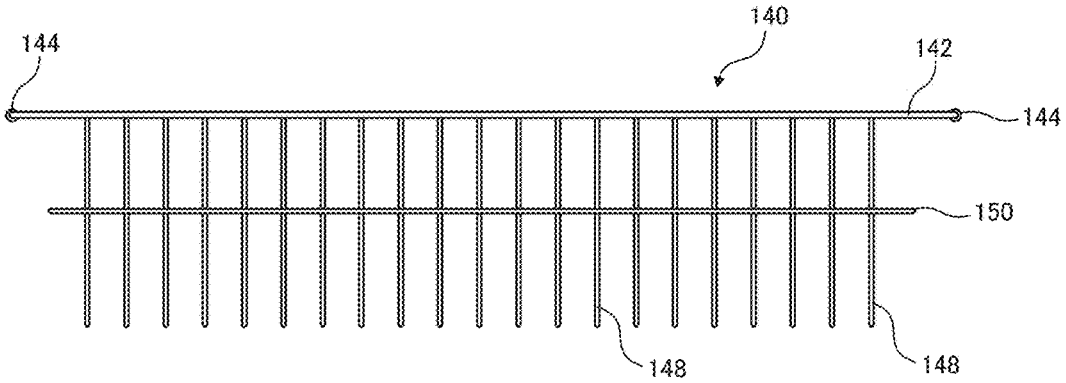
Figure 16:
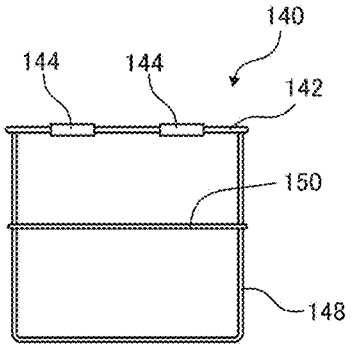
Figure 17:
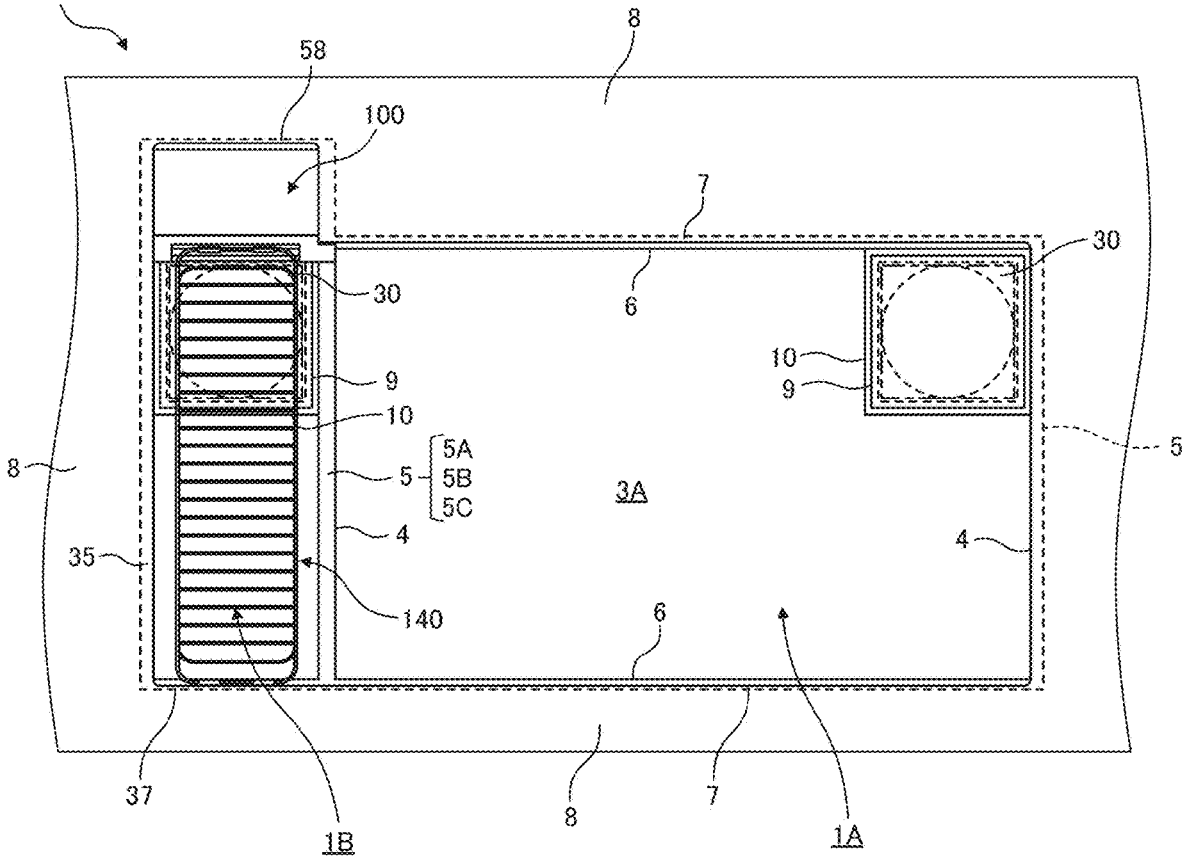
FIG. 17 is a plan view illustrating a state where a draining basket is held by the holding member in the another embodiment 1.

Here, a draining basket 140 to be held by the holding member 100 will be described with reference to FIGS. 16 and 17. FIG. 16(*a*) is a plan view illustrating a structure of the draining basket, (*b*) is a side view of the draining basket in (*a*), and (*c*) is a front view of the draining basket in (*a*). FIG. 17 is a plan view illustrating a state where the holding member in the another embodiment 1 holds the draining basket.

The draining basket 140 is configured to include a first horizontal ring (upper ring) portion 142 with a substantially oval shape, a second horizontal ring portion 150 with a substantially oval shape, and a plurality of vertical ring portions (accommodating wires) 148 with a substantially U shape. Non-slip grips (such as rubber or a resin) 144 are attached to both ends of the first horizontal ring portion 142 in the longitudinal direction. The first horizontal ring portion 142 is located at the uppermost part of the basket, and the plurality of vertical ring portions 148 are each joined to mutually facing positions (two locations) of the first horizontal ring portion 142 at equal intervals and are formed vertically downward from the first horizontal ring portion 142. The second horizontal ring portions 150 are each joined at mutually facing positions (two locations) of the vertical ring portion 148 at a height position of about half the height of the basket.

Another Embodiment 3

Figure 15:
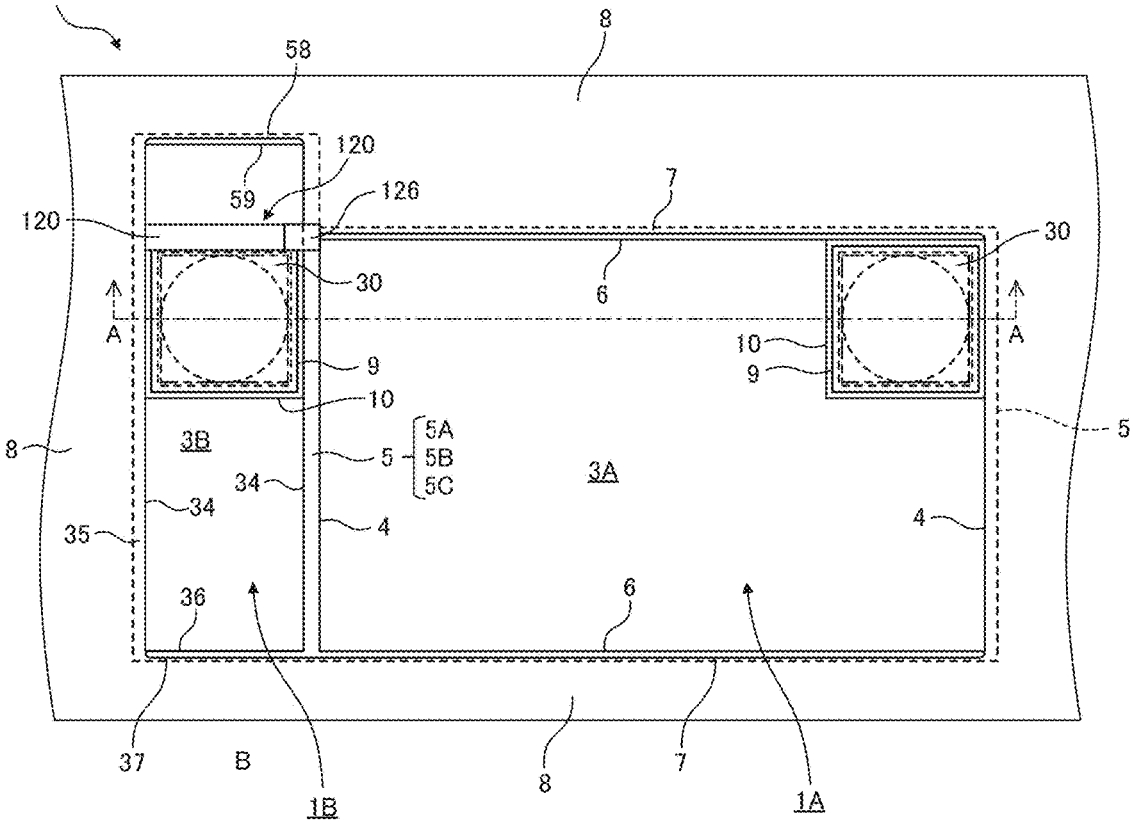
FIG. 15(*a*) is a plan view illustrating a state where the holding member in the another embodiment 3 is placed on a second sink, and FIG. 15(*b*) is a sectional view along the line A-A in FIG. 15(*a*).
Figure 15:
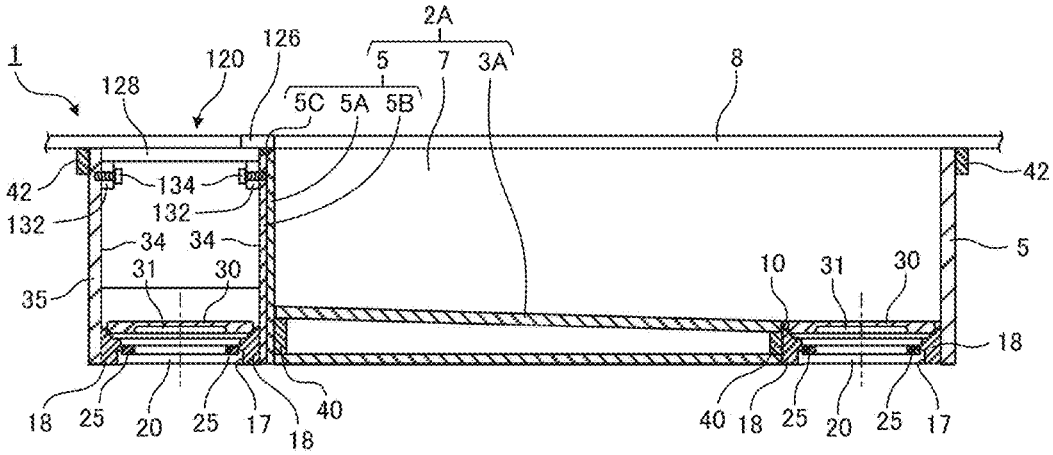

Although the holding member 100 in the aforementioned another embodiment 2 is characterized in that the positioning board 101 with a substantially U shape forms the recessed portion 109, the holding member 100 may have a shape as illustrated in FIG. 13. FIG. 13(*a*) is a perspective view illustrating a structure of a holding member in another embodiment 3, and (*b*) is a side view of the holding member in (*a*). FIG. 15(*a*) is a plan view illustrating a state where the holding member in the another embodiment 3 is placed on a second sink; and (*b*) is a sectional view along the line A-A in (*a*).

As illustrated in FIG. 13, a holding member (support part) 120 is configured to include a support board 128, arm portions 132 and 132 joined to both ends of the support board 128, and a positioning board 126 with a rectangular shape. The positioning board 126 and the support board 128 form a stepped portion (recessed portion) 139. The dimension of the stepped portion 139 in the longitudinal direction is preferably longer than the width of a draining basket (see FIG. 16). Insertion holes 130 and 130 for inserting screw members (such as bolts) 134 are formed in arm portions 132 and 132, respectively. Spiral grooves are formed in the insertion holes 130 and 130. Since the holding member 120 is movable in the depth direction of the second sink 1B in a state before the holding member 120 is tightened and fixed with the screw members 134, the holding member 120 is positioned and adjusted to substantially coincide with the depth dimension of the draining basket to be held and is then tightened and fixed with the screw members 134.

The holding member 120 is tightened and fixed at a predetermined position of an opening of the second sink 1B with the screw members 134. Specifically, a part of the positioning board 126 of the holding member 120 is placed on an upper end surface of the side board 5, the screw members 134 are inserted into the insertion holes 130 in the left and right arm portions 132 while being rotated with the holding member 120 horizontally maintained, a pressure is applied from the inside to the outside, and distal ends of the screw members 134 are caused to abut on, and fastened and fixed to, the surfaces of the side board 5*b* and 35 as illustrated in FIGS. 15(*a*) and (*b*). If washed tableware, foods, and the like are accommodated in a draining basket by placing and holding the draining basket (see FIG. 16) at an upper end edge of the stepped portion 139 and the side board 37 on the shorter side, it is possible to hold and save the washed tableware, foods, and the like without placing them directly on the bottom board 3B and to thereby satisfy a requirement of a user in terms of hygiene, for example.

Effects of the Present Embodiments

Since the first sink (wide sink) and the second sink (slim sink) configure the shape of the kitchen sink, the depth of the second sink is longer than that of the first sink, and the thus elongated part is used as an accommodating portion (accommodating pocket) with a stepped portion in which a dishwashing detergent, a dishwashing sponge, a cutting board, and the like can be accommodated, it is possible to improve working efficiency and to improve hygiene. Also, it is possible to perform a work such as washing without placing stuff on the top board and to thereby maintain an exterior that does not damage the sink design even during a work, when the sink is overlooked.

The drainage flow path 31 is not visible from the exterior, and the water flowing hole 21 is not visible from the drainage flow path 31 of the lid 30 located at the drainage outlet 9 as well by the drainage flow path 31 being provided at each side of the lower surface of the lid 30, the drainage outlet 9 is integrated with the sink 1, and a sense of luxury with no unnatural feeling can be maintained.

It is possible to eliminate an unnatural feeling from the lid 30 when the sink 1 is overlooked by forming the lid 30 covering the drainage outlet 9 and the peripheral edge of the drainage outlet 9 to have the heights substantially in the same plane. Moreover, it is possible to facilitate flowing of discharged water at the peripheral edge part of the drainage outlet 9 and to prevent water from staying at the peripheral edge of the drainage outlet 9 and the surface portion 32 of the lid 30 due to a surface tension of flowing water, that is, so-called dead water by forming the center part of the surface portion 32 of the lid 30 to be flat and integrally forming the inclined surface 38 obtained by gently inclining the peripheral edge of the surface portion 32, and it is thus hygienic.

Furthermore, since the surface portion 32 of the lid 30 and the bottom surface of the sink 1 are located on the same plane, it is possible to form the entire bottom surface of the sink 1 to be flat, to widely use the sink bottom surface, to thereby place stuffs to be washed such as large tableware like dishes, pots, and the like, and to stably position the lid 30 without displacement even if tableware, pots, and the like before washing are placed in the sink.

For detachment of the lid 30 attached to the drainage outlet 9, it is possible to easily hook the rear side of the lid 30 by putting fingers into a gap between the drainage outlet 9 and the lid 30 and folding the fingers, and to easily pull out the lid 30 by lifting it upward in the state where the fingers are folded.

REFERENCE SIGNS LIST

1 Kitchen sink
2A, 2B Sink main body
3A, 3B Bottom board
5, 5A, 5B, 7, 35, 36, 37, 58 Side board
8 Top board
9 Drainage outlet
10 Inclined surface
11 Fitting portion
12 Corner piece
13 Slope portion
15 Water flowing hole
16 Locking step portion
17 Drainage frame
18 Fixation frame
20 Drainage tube
25 Fixation ring
30 Lid
31 Drainage flow path
32 Surface portion
33 Locking portion
37, 58 Side board
38 Inclined surface
40 Coupling member (coupling piece)
45, 59*a*, 59*b* Coupling member
57 Accommodating portion
61 Front hanging part
70 Bracket
71 Holding portion
73 Hook portion
75 Screw member
100, 120 Holding member
101, 126 Positioning board
104, 106 Leg portion
108, 128 Support board
109, 139 Recessed portion
112, 132 Arm portion
114, 134 Screw member
139 Stepped portion

The invention claimed is:

1. A kitchen sink comprising:

a first sink including a first sink main body that includes a first bottom board obtained by inclining an entire inner bottom surface in a direction of a first drainage outlet provided at a corner on one side, a pair of first side boards attached to short sides of the first bottom board on both left and right sides, and a pair of first long boards attached to long sides of the first bottom board in a front-rear direction; and a second sink including a second sink main body that includes a second bottom board obtained by inclining an entire inner bottom surface in a direction of a second drainage outlet provided at a corner on one side, a pair of second side boards attached to short sides of the second bottom board on both front and rear sides, and a pair of second long boards attached to long sides of the second bottom board in a left-right direction, wherein the first sink main body includes a first lid detachably attached to cover the drainage outlet in the first bottom board, the second sink main body includes a second lid detachably attached to cover the drainage outlet in the second bottom board, an accommodating portion is formed in the second sink, depth dimensions of the first sink main body and the second sink main body are the same, a depth dimension of the second sink is longer than a depth dimension of the first sink, and the accommodating portion is formed in an area other than the second sink main body in the second sink, and the accommodating portion is configured to include a first side board, a stepped portion, and a second side board, and a height of the first side board is equal to or greater than a height of the second lid.

2. The kitchen sink of claim 1, wherein holding members for holding an accommodating basket are attached to an opening of the second sink.

3. The kitchen sink of claim 1, wherein the first lid and the second lid include drainage flow paths each formed at a center of four sides of a bottom surface formed into a square shape, with locking portions provided at four corners of the bottom surface.

4. The kitchen sink of claim 3, wherein locking portions of the first lid and the second lid abut slope portions of corner pieces provided at respective sides of the drainage outlets.

5. The kitchen sink of claim 1, wherein inclined surfaces are provided at edges of two sides of the drainage outlets in the sink main bodies in contact with inner bottom surfaces of the bottom boards, fitting portions with substantially square shapes are attached to be lower than edges of the drainage outlets, and corner pieces with slope portions are attached to respective sides of the fitting portions.

6. The kitchen sink of claim 1, wherein the first lid and the second lid are provided with inclined surfaces obtained by inclining entire peripheral edges of surface portions.

7. The kitchen sink of claim 1, wherein the first sink main body and the second sink main body, a top board, the first lid and the second lid, and the accommodating portion are formed from an imitation board material obtained by molding and working a synthetic resin material, by molding and working crushed crystal with a synthetic resin material, or by molding and working ceramic tiles.

* * * * *